US007913613B2

(12) United States Patent
Muth et al.

(10) Patent No.: US 7,913,613 B2
(45) Date of Patent: Mar. 29, 2011

(54) PISTON/CYLINDER UNIT

(75) Inventors: Michael Muth, Munich (DE); Georg Slotta, Neufahrn (DE)

(73) Assignees: BSH Bosch und Siemens Hausgeraete GmbH, Munich (DE); AeroLas GmbH, Unterhacing (DE)

( * ) Notice: Subject to any disclaimer, the term of this patent is extended or adjusted under 35 U.S.C. 154(b) by 347 days.

(21) Appl. No.: 11/794,010

(22) PCT Filed: Dec. 22, 2005

(86) PCT No.: PCT/EP2005/013864

§ 371 (c)(1),
(2), (4) Date: Jun. 21, 2007

(87) PCT Pub. No.: WO2006/089582

PCT Pub. Date: Aug. 31, 2006

(65) Prior Publication Data

US 2008/0008610 A1 Jan. 10, 2008

(30) Foreign Application Priority Data

Dec. 22, 2004 (DE) ..... 10 2004 061 940

(51) Int. Cl.
*F16J 10/02* (2006.01)

(52) U.S. Cl. ..... 92/169.1; 92/DIG. 2

(58) Field of Classification Search ..... 92/169.1, 92/DIG. 2

See application file for complete search history.

(56) References Cited

U.S. PATENT DOCUMENTS

| | | | | |
|---|---|---|---|---|
| 1,996,160 | A | | 4/1935 | Koenig |
| 2,315,222 | A | | 3/1943 | Philipp |
| 2,907,304 | A | * | 10/1959 | Macks ..... 92/162 R |
| 3,777,722 | A | * | 12/1973 | Lenger ..... 92/153 |
| 4,634,297 | A | | 1/1987 | Schriwer |
| 4,966,789 | A | | 10/1990 | Knapp et al. |
| 4,974,498 | A | | 12/1990 | Lemelson |
| 5,140,905 | A | | 8/1992 | Dhar |
| 5,186,137 | A | | 2/1993 | Salzmann |
| 5,255,521 | A | | 10/1993 | Watanabe |
| 5,318,412 | A | | 6/1994 | Laskaris et al. |
| 5,525,845 | A | | 6/1996 | Beale et al. |
| 5,772,410 | A | | 6/1998 | Chang |
| 5,779,455 | A | | 7/1998 | Steiger |
| 6,073,648 | A | | 6/2000 | Watson et al. |

(Continued)

FOREIGN PATENT DOCUMENTS

AT 007 706 U 7/2005

(Continued)

*Primary Examiner* — F. Daniel Lopez

(74) *Attorney, Agent, or Firm* — James E. Howard; Andre Pallapies

(57) ABSTRACT

A piston/cylinder unit comprising a cylinder, a piston which reciprocates in the axial direction of the cylinder between first and second piston positions, and a fluid bearing provided between the piston and the cylinder which supports the piston such as to be axially displaceable in the cylinder and defines the piston-side bearing surface, enclosing the circumference of the piston at least over a part of the axial extension of the piston, whereby the fluid bearing comprises a number of outlet nozzles for the fluid arranged in the inner circumferential wall of the cylinder. The outlet nozzles are arranged such that when the piston is in the second position, first outlet nozzles provide the front or middle region of the piston-side bearing surface relative to the piston longitudinal extension and second outlet nozzles provide the middle region of the piston side bearing surface with pressure fluid.

19 Claims, 1 Drawing Sheet

U.S. PATENT DOCUMENTS

| | | | |
|---|---|---|---|
| 6,506,032 | B2 | 1/2003 | Kawahara et al. |
| 6,641,377 | B2 | 11/2003 | Toyama et al. |
| 2002/0155012 | A1 | 10/2002 | Zabar |
| 2005/0144967 | A1 | 7/2005 | Hebestreit et al. |
| 2005/0244290 | A1 | 11/2005 | Inagaki et al. |
| 2006/0083628 | A1 | 4/2006 | Kanai et al. |

FOREIGN PATENT DOCUMENTS

| | | |
|---|---|---|
| DE | 81 32 123 U | 4/1985 |
| DE | 198 02 453 | 8/1999 |
| EP | 0 864 750 | 9/1998 |
| EP | 0 909 895 | 4/1999 |
| EP | 1 045 145 | 10/2000 |
| EP | 1 126 171 | 8/2001 |
| EP | 1 450 042 | 8/2004 |
| FR | 743.398 | 3/1933 |
| GB | 1 222 425 | 2/1971 |
| JP | 2002-349435 | 12/2002 |
| JP | 2003-49943 | 2/2003 |
| JP | 2004-361039 | 12/2004 |
| WO | WO 89/03480 | 4/1989 |
| WO | WO 00/70223 | 11/2000 |
| WO | WO 03/081041 | 10/2003 |

* cited by examiner

PISTON/CYLINDER UNIT

The invention relates to a piston/cylinder unit, in particular for a compressor for producing a pressure fluid, comprising a cylinder, a piston which can reciprocate in the axial direction of the cylinder between a first piston position in which the cylinder volume enclosed by the piston and the cylinder is a maximum and a second piston position in which this cylinder volume is a minimum, and a fluid bearing provided between the piston and the cylinder which supports the piston such that it can be displaced axially in the cylinder and which defines a piston-side bearing surface, enclosing the circumference of the piston at least over a part of the axial extension of the piston, the fluid bearing comprising a plurality of outlet nozzles for the fluid provided in the inner circumferential wall of the cylinder.

BACKGROUND OF THE INVENTION

Such a piston/cylinder unit is known from U.S. Pat. No. 5,525,845 A. In this known piston/cylinder unit outlet nozzles are provided in the cylinder wall which support the piston in its first piston position and in its second piston position. In order to make this possible, the outlet nozzles are located relatively far from the cylinder base, that is from the front inner wall of the cylinder bore. This has the consequence that the fluid cushion formed between the piston circumference and the inner circumference of the cylinder for bearing the piston in the cylinder in the area of the front circumferential region adjacent to the piston base becomes weaker, the further the piston migrates into its second piston position, that is the compression position. As a result of the high pressure produced simultaneously during the compression in the cylinder volume, compressed fluid penetrates from the cylinder volume into the bearing gap between the outer circumference of the piston and the inner circumference of the cylinder which, when this penetrates asymmetrically along the circumference, results in a lateral deflection of the piston and therefore in undesired tipping of the piston.

Known from JP 2002-349 435 A is a piston/cylinder unit which is driven by a linear motor and is guided freely on a gas cushion in the piston-ring-free piston. For stabilising this gas cushion, the piston is provided with a circumferential groove on its circumference. This circumferential groove is designed to reduce the risk of the piston tilting in the cylinder. The circumferential groove not only weakens the transverse force disadvantageously for the bearing of the piston but also the air bearing as a whole so that the effect of the circumferential groove relative to the air bearing is rather disadvantageous.

SUMMARY OF THE INVENTION

It is thus the object of the present invention to provide a generic piston/cylinder unit in such a manner that even when the piston moves into the compression position or is located in the compression position, sufficiently reliable mounting of the piston in the cylinder and therefore security against lateral deflection of the piston is ensured.

This object is achieved by a piston/cylinder unit having the features illustrated in the exemplary embodiments.

The arrangement of the outlet nozzles in such a manner that that when the piston is in the second position thereof, first outlet nozzles provide the front or middle region of the piston-side bearing surface relative to the longitudinal extension of the piston and second outlet nozzles provide the middle region of the piston-side bearing surface relative to the longitudinal extension of the piston with pressure fluid, ensures reliable mounting and radial positioning of the piston in the cylinder without the piston being able to come in contact with the cylinder. As a result of the arrangement of the outlet nozzles in the central region or in the front and central region, it is achieved that during penetration of pressure from the compression chamber into the bearing gap surrounding the piston, the centre of gravity or centre of force of the bearing remains in the central or front region of the piston and in any case only migrates slightly towards the back, thus ensuring reliable radial support of the piston via the bearing fluid in the middle and also in the front region of the piston so that the influence of the pressure in the compression chamber on the pressure prevailing in the bearing gap is reduced significantly compared with conventional solutions.

It is advantageous in this case if the nozzle arrangements are arranged such that outlet nozzles are also provided in the region of the inner circumferential wall of the cylinder to which the piston lies opposite in the second piston position but not in the first piston position. As a result, in the compression state a fluid cushion is reliably formed between the inner circumferential wall of the cylinder and the outer circumferential wall of the piston without this being expelled from the cylinder volume by penetration of compressed fluid. In this embodiment, the piston is more reliably supported against the inner circumferential wall of the cylinder on the fluid cushion in the second piston position, that is, in the compression position of the piston.

In a preferred embodiment, the outlet nozzles are arranged such that when the piston is located in its second piston position, first outlet nozzles provide the front region of the piston-side bearing surface relative to the longitudinal extension of the piston and second outlet nozzles provide the middle or rear region of the piston-side bearing surface relative to the longitudinal extension of the piston with pressure fluid. If the outlet nozzles are provided in the front and rear region of the piston-side bearing surface in this case, in the compression position of the piston a particularly uniform support of the piston via its longitudinal extension is achieved. However, it is also advantageous if the first outlet nozzles are provided in the front region and the second outlet nozzles in the middle of the piston-side bearing surface, so that the centre of gravity or centre of force of the bearing extends forwards, that is towards the piston base. As a result, in the area of the front end of the ring gap between the piston and cylinder, that is towards the cylinder volume, a higher pressure is built up in the fluid bearing between the piston and cylinder which offers a higher resistance to the compressive pressure in the cylinder volume and thus more efficiently prevents the compressed pressure fluid from penetrating into the bearing gap from the cylinder volume.

In another optional embodiment, the outlet nozzles are arranged in such a manner that when the piston is located in its first piston position, the second outlet nozzles provide the front region of the piston-side bearing surface relative to the longitudinal extension of the piston and third outlet nozzles provide the rear region of the piston-side bearing surface relative to the longitudinal extension of the piston with pressure fluid. These optionally provided third outlet nozzles in the rear region can effect improved support of the piston in its withdrawn position.

It is particularly preferred if the fluid bearing is formed by a gas pressure bearing, the outlet nozzles being formed by gas outlet nozzles; an advantageous and particularly preferred embodiment is the air bearing.

Preferably, a plurality of outlet nozzles form nozzle arrangements in each case.

The nozzle arrangements are preferably spaced apart from one another in the axial direction of the piston/cylinder unit and are preferably formed in a ring shape around the cylinder axis. A particularly uniform fluid or gas cushion is hereby formed between the piston and the cylinder.

It is also advantageous for the formation of a particularly uniform fluid or gas cushion between the piston and the cylinder if each nozzle ring comprises a plurality of outlet nozzles uniformly spaced apart from one another in the circumferential direction.

The outlet nozzles are formed preferably formed by micro-holes drilled by an energetic beam, which are preferably configured as conical, wherein the narrowest cross-section is located at the mouth into the cylinder-side bearing surface. The micro-holes produced in this way produce a fluid or gas cushion having high uniformity and high bearing capacity.

These micro-holes are preferably drilled by means of a laser beam.

If the pressure fluid for supplying the outlet nozzles is removed from a fluid flow compressed by compression of the cylinder volume, for example, from the outlet channel, a simple structure of the piston-cylinder unit can be achieved and at the same, an additional pressure generator for the pressure fluid for supplying the outlet nozzles can be dispensed with, helping to make such a piston/cylinder unit cost-effective to produce.

This piston/cylinder unit is particularly preferred if the piston is acted upon by a movable part of a linear drive for the reciprocating drive.

An advantageous application of the piston-cylinder unit according to the invention which is particularly to be stressed, is in a compressor for generating a pressure fluid, preferably in a linear compressor driven by a linear motor.

Further advantageous embodiments of the invention are specified in the remaining dependent claims.

BRIEF DESCRIPTION OF THE DRAWINGS

The invention is explained in detail hereinafter using an example with reference to the drawings; in the figures.

DETAILED DESCRIPTION OF THE EXEMPLARY EMBODIMENTS OF THE PRESENT INVENTION

Figure 1:
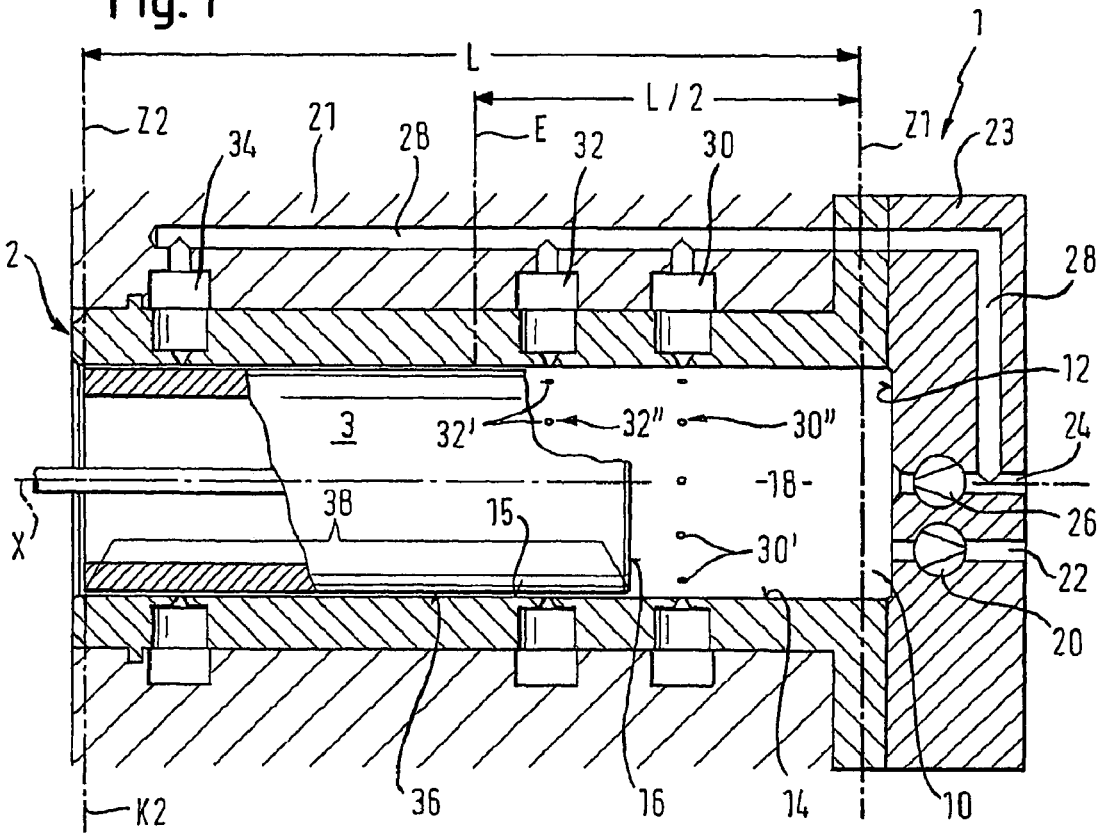
FIG. 1 is a schematic longitudinal section through a piston-cylinder arrangement according to the invention with the piston in a first piston position and FIG. 2 is the same piston-cylinder unit with the piston in the compression position.

FIG. 1 is a longitudinal section through a piston-cylinder unit 1 comprising a cylinder 2 and a piston 3. The cylinder 2 is provided with a cylinder bore 10 which accommodates the piston 3 so that it can move to and fro and be freely guided in the direction of the longitudinal axis X of the cylinder bore 10. The front wall 12 of the cylinder bore 10 formed on the head side at a cylinder head 23, the inner circumferential wall 14 of the cylinder bore 10 and piston base 16 define the cylinder volume 18.

An inlet channel 22 provided with a valve 20 shown schematically opens into the head-side front wall 12 of the cylinder bore 10. Also provided in the head-side front wall 12 is an outlet channel 24 which has a corresponding valve 26; this outlet channel also opens into the cylinder bore 10.

FIG. 1 also shows that a cylinder-side bearing surface 15 extends from a front boundary plane Z1 which coincides with a front piston-side boundary plane K1 of a piston-side bearing surface 38 when the piston 3 is in its second piston position shown in FIG. 3, and a rear boundary plane Z2 which coincides with a rear boundary line K2 of the piston-side bearing surface 38 facing away from the piston base 16 when the piston 3 is located in is first piston position shown in FIG. 1. The length of the cylinder-side bearing surface 15 is divided into two halves each of length L/2 by a bearing surface central plane E which is at right angles to the cylinder-side bearing surface 15.

FIG. 1 also shows that more outlet nozzles 30', 32' are provided in the front region of the cylinder-side bearing surface 15 than in its rear region where merely the optionally provided outlet nozzles 34' are shown. This asymmetric arrangement of the outlet nozzles relative to the bearing surface central plane E has the effect that the distribution of the nozzle cross-sectional areas of the outlet nozzles over the length L of the cylinder-side bearing surface 15 is also asymmetrical relative to the bearing surface central plane E. Such asymmetry can be achieved not only by providing a different number of outlet nozzles in the front or rear region of the cylinder-side bearing surface 15 but, for example, also by the outlet nozzles in the front area of the cylinder-side bearing surface 15 having a larger diameter and therefore a larger cross-sectional area than those outlet nozzles located in the rear region of the cylinder-side bearing surface 15.

Figure 2:
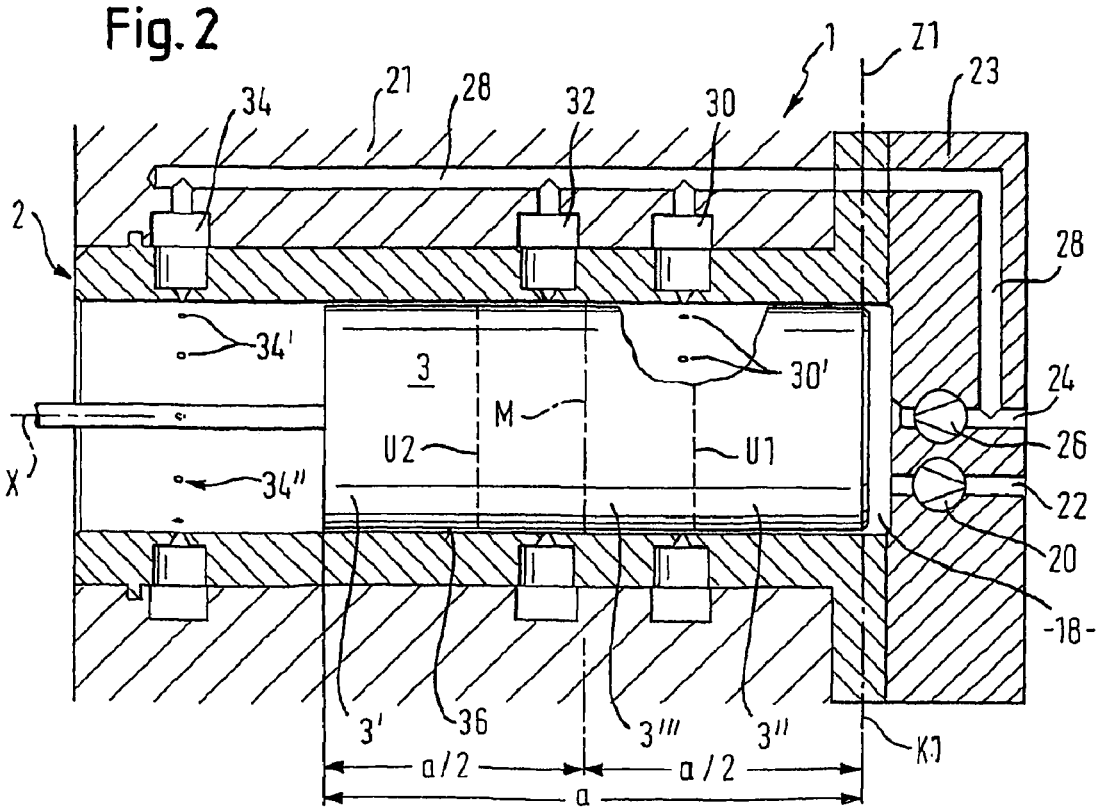

During a movement of the piston 2 to the left in FIG. 2, fluid is sucked into the cylinder space 16 through the inlet channel 22 and the inlet valve 20 and during a movement of the piston to the right, this fluid is expelled in the compressed state through the outlet valve 26 and the outlet channel 24. The piston/cylinder unit 1 shown is part of a piston machine in which the expelled fluid is gaseous, as is the case for example in a compressor. The invention can fundamentally be applied, however, to other piston machines such as, for example, internal combustion engines or pumps.

Some of the expelled gaseous fluid is guided from the outlet channel 24 through a connecting channel 28 provided in the cylinder head 23 and in the housing 21 of the cylinder 2, into ring channels 30, 32, 34 which are likewise provided in the housing 21 of the cylinder 2 and which surround the cylinder bore 10 in an annular configuration. The ring channels 30, 32, 34 are spaced apart from one another in the direction of the longitudinal axis X of the cylinder bore 10. Each of the ring channels 30, 32, 34 is provided with a plurality of micro-holes 30', 32', 34' which are distributed uniformly over the circumference of the cylinder bore 10 and connect the respective ring channel 30, 32, 34 to the interior of the cylinder bore 10 and thereby penetrate through the inner wall 14 of the cylinder. The micro-holes 30', 32', 34' of each ring channel 30, 32, 34 thus form a respective annular nozzle arrangement 30", 32", 34". Pressurised gas is passed through the connecting channel 28 into the ring channels 30, 32, 34 and can thus escape through the micro-holes 30', 32', 34' and form a gas cushion which laterally supports the piston between the cylinder-side bearing surface 15 on the inner circumferential wall 4 of the cylinder 2 and a piston-side bearing surface 38 on the outer circumferential wall 36 of the piston 3.

The first ring channel 30 with the micro-holes 30' assigned thereto is located in a region in which the piston only covers the micro-holes 30' when it is close to the compression position, that is when the cylinder volume 18 is minimised, as shown in FIG. 2. In this case, the piston 3 covers the front, first micro-holes with the bearing surface 38 in the front region 3".

In the position shown in FIG. 1 in which the cylinder volume 18 is greatest, the front-most micro-holes 30' do not contribute to the formation of a gas cushion between the inner circumferential wall 14 of the cylinder 2 and the outer circumferential wall 36 of the piston. However, as a result of the extremely small cross-section of the micro-holes 30', the pressure loss thus produced is not serious. However, there can also be provided a valve arrangement (not shown) which only acts upon the first ring channel 30 with pressure gas when the piston 3 covers the micro-holes 10.

The second ring channel 32 is arranged so that the micro-holes 32' allocated to it are always covered by the piston 3 so that over the entire axial movement path of the piston 3 the micro-holes 32' contribute to the formation of the gas cushion between the inner circumferential wall 14 of the cylinder 2 and the outer circumferential wall 36 of the piston 3.

The third ring channel 34 is furthest removed from the head-side front wall 12 of the cylinder bore. The micro-holes 34' allocated to the third ring channel 34 are thus only covered by the piston 3 and specifically by the bearing surface 38 in the rear region 3' of the piston when the piston 3 is located in the area of its withdrawn position in which the cylinder volume 18 is greatest. The provision of the third ring channel 34 with the micro-holes 34' allocated to it is optional and is merely used to further improve the running properties of the piston 3 in the cylinder bore 10.

In this case, the rear region 3' of the piston is defined as a region facing away from the piston base 16 relative to a central plane M (FIG. 2) orthogonal to the piston-side bearing surface 38. The front piston region 3" is accordingly a region facing the front end of the piston 3 on the piston base side relative to the central plane M. Between the rear piston region 3' and the front piston region 3" is a central piston region 3'" defined as a region in front of and behind the piston central plane M. The piston central plane M is orthogonal to the piston-side bearing surface 38 and lies at the centre at half the bearing surface length a/2 relative to the bearing surface length a of the piston-side bearing surface 38. The central piston region 3'" is delimited from the front piston region 3" by a front circumferential line U1 which is an imaginary circumferential line running in a plane parallel to the piston central line M. Similarly, the central piston region 3'" is delimited from the rear piston region 3' by a rear circumferential line U2 which is an imaginary line running in a plane parallel to the piston central plane M. The front circumferential line U1 and the rear circumferential line U2 each have an axial distance of up to 20%, preferably up to 15%, more preferably up to 10% of the bearing surface length a from the piston central plane M. In this case, the distance of the front circumferential line U1 to the piston central plane M must not be the same as the distance from the rear circumferential line U2 to the piston central plane M although a symmetrical arrangement of the circumferential lines U1, U2 to the piston central plane M is preferred.

Further annular nozzle arrangements having a similar structure can be provided in the inner wall 14 of the cylinder bore 10 between the ring channels 30, 32, 34 with their allocated micro-holes 30', 32', 34', each forming the annular nozzle arrangements 30", 32", 34".

In one embodiment of the piston/cylinder unit according to the invention which has proved useful in practice, the first outlet nozzles 30' and the second outlet nozzles 32' are arranged such that in the second front piston position shown in FIG. 2, they act upon the middle region 3'" of the piston 3 with pressure fluid whilst in this piston position, no outlet nozzles act upon the rear piston region 3'. In this case, as shown in FIG. 2, the outlet nozzles 30', 32' can be slightly offset relative to the piston central plane M in the direction of the front piston region 3'.

The invention is not restricted to the above exemplary embodiment which merely serves to give a general explanation of the basic idea of the invention. Rather, the device according to the invention can have embodiments other than those described above within the scope of protection. In particular, the device can have features which represent a combination of the respective individual features of the claims.

Reference numerals in the claims, the description and the drawings merely serve to give a better understanding of the invention and should not restrict the scope of protection.

The invention claimed is:

1. A piston/cylinder unit for a compressor for producing a pressure fluid comprising:

a cylinder;

a piston being reciprocable in an axial direction of the cylinder between a first piston position, in which a cylinder volume enclosed by the piston and the cylinder is a maximum, and a second piston position, in which this cylinder volume is a minimum;

a fluid bearing provided between the piston and the cylinder which supports the piston such that the piston is displaceable axially in the cylinder and which defines a piston-side bearing surface, enclosing a circumference of the piston at least over a part of an axial extension of the piston;

wherein the fluid bearing comprises a plurality of outlet nozzles for a fluid provided in an inner circumferential wall of the cylinder, and wherein the plurality of outlet nozzles are arranged such that when the piston is in the second position thereof, first outlet nozzles of the plurality of outlet nozzles provide a front region of the piston-side bearing surface relative to a longitudinal extension of the piston, the first outlet nozzles provided in a region of the inner circumferential wall of the cylinder to which the piston lies opposite in the second piston position but to which the piston does not lie opposite in the first piston position, and second outlet nozzles of the plurality of outlet nozzles provide a middle region of the piston-side bearing surface relative to the longitudinal extension of the piston with pressure fluid such that a centre of force gravity of the bearing extends forwards towards a piston base whereby a higher pressure in the fluid bearing between the piston and cylinder is established in an area of a front end of a ring gap between the piston and the cylinder.

2. The piston/cylinder unit according to claim 1, wherein the middle piston region is defined as a region in front of and behind a piston central plane, wherein the piston central plane is orthogonal to the piston-side bearing surface and lies relative to a bearing surface length of the piston-side bearing surface in a centre at half the bearing surface length.

3. The piston/cylinder unit according to claim 2, wherein the middle piston region extends from a front circumferential line as far as a rear circumferential line, wherein the front circumferential line is located at a distance of up to 20% of the bearing surface length in front of the piston central plane towards the piston base and wherein the rear circumferential line is located at a distance of up to 20% of the bearing surface length after the piston central plane away from the piston base.

4. The piston/cylinder unit according to claim 2, wherein the middle piston region extends from a front circumferential line as far as a rear circumferential line, wherein the front circumferential line is located at a distance of up to 15% of the bearing surface length in front of the piston central plane towards the piston base and wherein the rear circumferential line is located at a distance of up to 15% of the bearing surface length after the piston central plane away from the piston base.

5. The piston/cylinder unit according to claim 2, wherein the middle piston region extends from a front circumferential line as far as a rear circumferential line, wherein the front circumferential line is located at a distance of up to 10% of the bearing surface length in front of the piston central plane towards the piston base and wherein the rear circumferential line is located at a distance of up to 10% of the bearing surface length after the piston central plane away from the piston base.

6. The piston/cylinder unit according to claim 1, wherein when the piston is located in the second piston position, none of the plurality of outlet nozzles supplies a rear region of the piston-side bearing surface relative to the longitudinal extension of the piston with pressure fluid.

7. The piston/cylinder unit according to claim 1, wherein the plurality of outlet nozzles are arranged in such a manner that when the piston is located in the first piston position, the second outlet nozzles provide the front region of the piston-side bearing surface relative to the longitudinal extension of the piston and third outlet nozzles provide a rear region of the piston-side bearing surface relative to the longitudinal extension of the piston with pressure fluid.

8. A piston/cylinder unit for a compressor for producing a pressure fluid comprising:

a cylinder;

a piston reciprocating in an axial direction of the cylinder between a first piston position in which a cylinder volume enclosed by a piston base surface of the piston and the cylinder is a maximum and a second piston position in which the cylinder volume enclosed by the piston base surface of the piston and the cylinder is a minimum; and a fluid bearing provided between the piston and the cylinder which supports the piston such that the piston is displaceable axially in the cylinder and which defines a piston-side bearing surface, enclosing a circumference of the piston at least over a part of an axial extension of the piston, wherein the fluid bearing comprises a plurality of outlet nozzles for a fluid provided in an inner circumferential wall of the cylinder, wherein a cylinder-side bearing surface extends from a front boundary plane that coincides with the piston base surface defining the cylinder volume when the piston is in the second piston position, and a rear boundary plane which coincides with a rear boundary line of the piston-side bearing surface facing away from the piston base surface when the piston is located in the first piston position, wherein the piston base surface coincides with a front piston-base-side boundary plane of the piston-side bearing surface when the piston is in the second piston position;

wherein a distribution of nozzle cross-sectional areas of the plurality of outlet nozzles over a length of the cylinder-side bearing surface relative to a bearing-surface central plane is asymmetrical, and wherein a sum of the nozzle cross-sectional areas of the plurality of outlet nozzles in a front region of the cylinder-side bearing surface is greater than a sum of the nozzle cross-sectional areas of the plurality of outlet nozzles in a rear region.

9. The piston/cylinder unit according to claim 8, wherein more outlet nozzles are provided in the front region of the cylinder-side bearing surface than in the rear region.

10. The piston/cylinder unit according to claim 8, wherein at least a part of the outlet nozzles provided in the front region of the cylinder-side bearing surface has a larger nozzle cross-sectional area than the remaining outlet nozzles.

11. The piston/cylinder unit according to claim 8, wherein the fluid bearing is formed by a gas pressure bearing, wherein the plurality of outlet nozzles are formed by gas outlet nozzles.

12. The piston/cylinder unit according to claim 8, wherein the plurality of outlet nozzles form nozzle arrangements, and, wherein the nozzle arrangements are spaced apart from one another in the axial direction of the piston/cylinder unit and are formed in a ring shape around a cylinder axis.

13. The piston/cylinder unit according to claim 8, wherein the plurality of nozzles form nozzle arrangements, and, wherein each nozzle arrangement comprises a plurality of outlet nozzles uniformly spaced apart from one another in a circumferential direction.

14. The piston/cylinder unit according to claim 8, wherein the outlet nozzles are formed by micro-holes drilled by an energetic beam, which are configured as conical, wherein the narrowest cross-section is located at a mouth into the cylinder-side bearing surface.

15. The piston/cylinder unit according to claim 14, wherein the micro-holes are drilled by means of a laser jet.

16. The piston/cylinder unit according to claim 8, wherein the pressure fluid for supplying the plurality of outlet nozzles is removed from a fluid flow compressed by compression of the cylinder volume.

17. The piston/cylinder unit according to claim 8, wherein the piston is acted upon by a movable part of a linear drive for a reciprocating drive.

18. A compressor for producing a pressure fluid comprising:

a compressor body including a piston machine, the piston machine including:

at least one piston/cylinder unit including:

a cylinder;

a piston being reciprocable in an axial direction of the cylinder between a first piston position, in which a cylinder volume enclosed by the piston and the cylinder is a maximum, and a second piston position, in which the cylinder volume is a minimum;

a fluid bearing provided between the piston and the cylinder which supports the piston such that the piston is displaceable axially in the cylinder and which defines a piston-side bearing surface, enclosing a circumference of the piston at least over a part of an axial extension of the piston;

wherein the fluid bearing comprises a plurality of outlet nozzles for a fluid provided in an inner circumferential wall of the cylinder, and wherein the plurality of outlet nozzles are arranged such that when the piston is in the second position thereof, first outlet nozzles of the plurality of outlet nozzles provide a front region of the piston-side bearing surface relative to a longitudinal extension of the piston, the first outlet nozzles provided in a region of the inner circumferential wall of the cylinder to which the piston lies opposite in the second piston position but to which the piston does not lie opposite in the first piston position, and second outlet nozzles provide a middle region of the piston-side bearing surface relative to the longitudinal extension of the piston with pressure fluid such that a centre of force of the bearing extends forwards towards a piston base surface whereby a higher pressure in the fluid bearing between the piston and cylinder is established in an area of a front end of a ring gap between the piston and the cylinder.

19. The piston/cylinder unit according to claim 11, wherein the gas pressure bearing is an air bearing.

* * * * *